US006327740B1

(12) United States Patent
Baltazar

(10) Patent No.: US 6,327,740 B1
(45) Date of Patent: Dec. 11, 2001

(54) LAUNDRY SINK ATTACHMENT FOR WRINGING MOPS

(76) Inventor: Robert Baltazar, 3924 N. Washington St., Westmont, IL (US) 60559

( * ) Notice: Subject to any disclaimer, the term of this patent is extended or adjusted under 35 U.S.C. 154(b) by 0 days.

(21) Appl. No.: 09/805,000

(22) Filed: Mar. 12, 2001

(51) Int. Cl.[7] ..... A47L 13/59; A47L 13/60
(52) U.S. Cl. ..... 15/261; 15/262
(58) Field of Search ..... 15/260, 261, 262

(56) References Cited

U.S. PATENT DOCUMENTS 676,625 * 6/1901 Hayden ..... 15/260
894,422 * 7/1908 Bugh ..... 15/260

FOREIGN PATENT DOCUMENTS

855357 * 5/1940 (FR) ..... 15/261

* cited by examiner

*Primary Examiner*—Randall E. Chin
(74) *Attorney, Agent, or Firm*—Goldstein Law Offices P.C.

(57) ABSTRACT

A laundry sink attachment for wringing mops including a pair of side brackets adapted for securement to the opposed side walls of the laundry sink. The pair of side brackets each include an interior and an exterior T-shaped plate. The interior plate is positionable on an inner surface of the side wall of the laundry sink. The exterior plate is positionable on an outer surface of the side wall of the laundry sink. The exterior plate has a pair of thumb screws extending inwardly thereof for engaging the opposed side wall in a secured orientation. The interior plates each have lateral channels formed therein. A wringer portion is secured between the pair of side brackets.

7 Claims, 2 Drawing Sheets

LAUNDRY SINK ATTACHMENT FOR WRINGING MOPS

BACKGROUND OF THE INVENTION

The present invention relates to a laundry sink attachment for wringing mops and more particularly pertains to allowing a wet mop to be easily wrung so as not to be required to lift a mop bucket to empty.

Typically, a person who is mopping uses a wringing attachment for a pail in order to wring their mop as needed. The use of this type of arrangement requires the person to initially fill the pail with clean water/cleaning solution so that the mop can be dipped in before being wrung out using the wringing attachment. The result of repeatedly continuing this process is a pail full of dirty water. This requires the person to lift the pail to a sink to empty the dirty water down the drain. This process can cause lower back strain that, after being done repeatedly, can result in permanent damage to the back. What is needed is a device that will allow a person to perform mopping duties by which they do not have to empty a pail full of dirty water into a sink so as to eliminate strain caused to the lower back.

The present invention attempts to solve the abovementioned problem by providing a device that allows a mop to be wrung directly into a laundry sink so that the use of a pail is eliminated thereby eliminating the need to lift a pail full of dirty water to empty.

The use of mop wringing devices is known in the prior art. More specifically, mop wringing devices heretofore devised and utilized for the purpose of wringing mops are known to consist basically of familiar, expected and obvious structural configurations, notwithstanding the myriad of designs encompassed by the crowded prior art that have been developed for the fulfillment of countless objectives and requirements.

By way of example, U.S. Pat. No. 4,720,879 to Rabban discloses a utility sink with a removable compression surface for wringing out a map. U.S. Pat. Nos. 3,987,513 to Gonzales and 5,274,877 to Morad disclose mop wringing devices used in conjunction with a pail.

While these devices fulfill their respective, particular objective and requirements, the aforementioned patents do not describe a laundry sink attachment for wringing mops for allowing a wet mop to be easily wrung so as not to be required to lift a mop bucket to empty.

In this respect, the laundry sink attachment for wringing mops according to the present invention substantially departs from the conventional concepts and designs of the prior art, and in doing so provides an apparatus primarily developed for the purpose of allowing a wet mop to be easily wrung so as not to be required to lift a mop bucket to empty.

Therefore, it can be appreciated that there exists a continuing need for a new and improved laundry sink attachment for wringing mops that can be used for allowing a wet mop to be easily wrung so as not to be required to lift a mop bucket to empty. In this regard, the present invention substantially fulfills this need.

SUMMARY OF THE INVENTION

In the view of the foregoing disadvantages inherent in the known types of mop wringing devices now present in the prior art, the present invention provides an improved laundry sink attachment for wringing mops. As such, the general purpose of the present invention, which will be described subsequently in greater detail, is to provide a new and improved laundry sink attachment for wringing mops that has all the advantages of the prior art and none of the disadvantages.

To attain this, the present invention essentially comprises a pair of side brackets adapted for securement to the opposed side walls of the laundry sink. The pair of side brackets each include an interior and an exterior T-shaped plate. The interior plate is positionable on an inner surface of the side wall of the laundry sink. The exterior plate is positionable on an outer surface of the side wall of the laundry sink. The exterior plate has a pair of thumb screws extending inwardly thereof for engaging the opposed side wall in a secured orientation. The interior plates each have lateral channels formed therein. A wringer portion is secured between the pair of side brackets. The wringer portion includes a fixed wringer and a slidable wringer. The fixed wringer and the slidable wringer each comprises a rectangular plate having a plurality of aperture's therethrough. The rectangular plate has a pair of side tabs extending outwardly from side edges thereof for being received within the lateral channels of the interior plates of the side brackets. The slidable wringer includes a handle member secured thereto to allow the slidable wringer to move inwardly against the fixed wringer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laundry sink attachment for wringing mops that has all the advantages of the prior art mop wringing devices and none of the disadvantages.

It is another object of the present invention to provide a new and improved laundry sink attachment for wringing mops that may be easily and efficiently manufactured and marketed.

It is a further object of the present invention to provide a new and improved laundry sink attachment for wringing mops that is of durable and reliable construction.

An even further object of the present invention is to provide a new and improved laundry sink attachment for wringing mops that is susceptible of a low cost of manufacture with regard to both materials and labor, and which accordingly is then susceptible of low prices of sale to the consuming public, thereby making such a laundry sink attachment for wringing mops economically available to the buying public.

Even still another object of the present invention is to provide a new and improved laundry sink attachment for wringing mops for allowing a wet mop to be easily wrung so as not to be required to lift a mop bucket to empty.

Lastly, it is an object of the present invention to provide a new and improved laundry sink attachment for wringing mops including a pair of side brackets adapted for securement to the opposed side walls of the laundry sink. The pair of side brackets each include an interior and an exterior T-shaped plate. The interior plate is positionable on an inner surface of the side wall of the laundry sink. The exterior plate is positionable on an outer surface of the side wall of the laundry sink. The exterior plate has a pair of thumb screws extending inwardly thereof for engaging the opposed side wall in a secured orientation. The interior plates each have lateral channels formed therein. A wringer portion is secured between the pair of side brackets.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
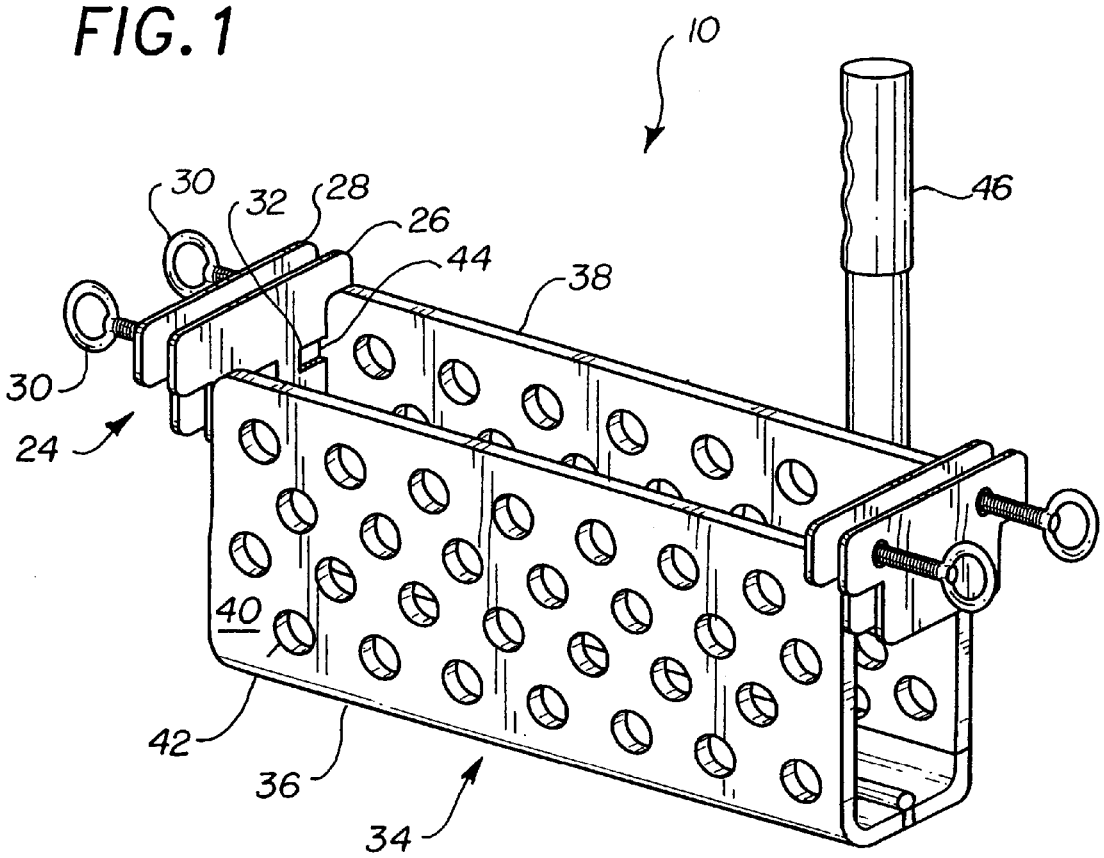
FIG. 1 is a perspective view of the preferred embodiment of the laundry sink attachment for wringing mops constructed in accordance with the principles of the present invention.

With reference now to the drawings, and in particular, to figures one through four thereof, the preferred embodiment of the new and improved laundry sink attachment for wringing mops embodying the principles and concepts of the present invention and generally designated by the reference number 10 will be described.

Specifically, it will be noted in the various figures that the device relates to a laundry sink attachment for wringing mops for allowing a wet mop to be easily wrung so as not to be required to lift a mop bucket to empty. In its broadest context, the device consists of a pair of side brackets and a wringer portion. Such components are individually configured and correlated with respect to each other so as to attain the desired objective.

The present invention is designed primarily for use on laundry sinks 12. These sinks 12 include an open upper end 14, a closed lower end 16, a front wall 18, a back wall 20, and opposed side walls 22.

The pair of side brackets 24 are adapted for securement to the opposed side walls 22 of the laundry sink 12. The pair of side brackets 24 each include an interior 26 and an exterior T-shaped plate 28. The interior plate 26 is positionable on an inner surface of the side wall 22 of the laundry sink 12. The exterior plate 28 is positionable on an outer surface of the side wall 22 of the laundry sink 12. The exterior plate 28 has a pair of thumb screws 30 extending inwardly thereof for engaging the opposed side wall 22 in a secured orientation. The thumb screws 30 can be tightened to engage the side brackets 24 to the side walls 22 of the sink 12. The interior plates 26 each have lateral channels 32 formed therein.

The wringer portion 34 is secured between the pair of side brackets 24. The wringer portion 34 includes a fixed wringer 36 and a slidable wringer 38. The fixed wringer 36 and the slidable wringer 38 each comprises a rectangular plate 40 having a plurality of apertures 42 therethrough. The rectangular plate 40 has a pair of side tabs 44 extending outwardly from side edges thereof for being received within the lateral channels 32 of the interior plates 26 of the side brackets 24. The slidable wringer 38 includes a handle member 46 secured thereto to allow the slidable wringer 38 to move inwardly against the fixed wringer 36. In use, an opening between the wringers 36,38 allows a mop head to be positioned therein. Once the mop head is positioned as such, the handle member 46 can be manipulated so that slidable wringer 38 moves inwardly to sandwich the mop head between the slidable wringer 38 and the fixed wringer 26 to properly wring water from the mop head directly into the sink 12.

Figure 2:
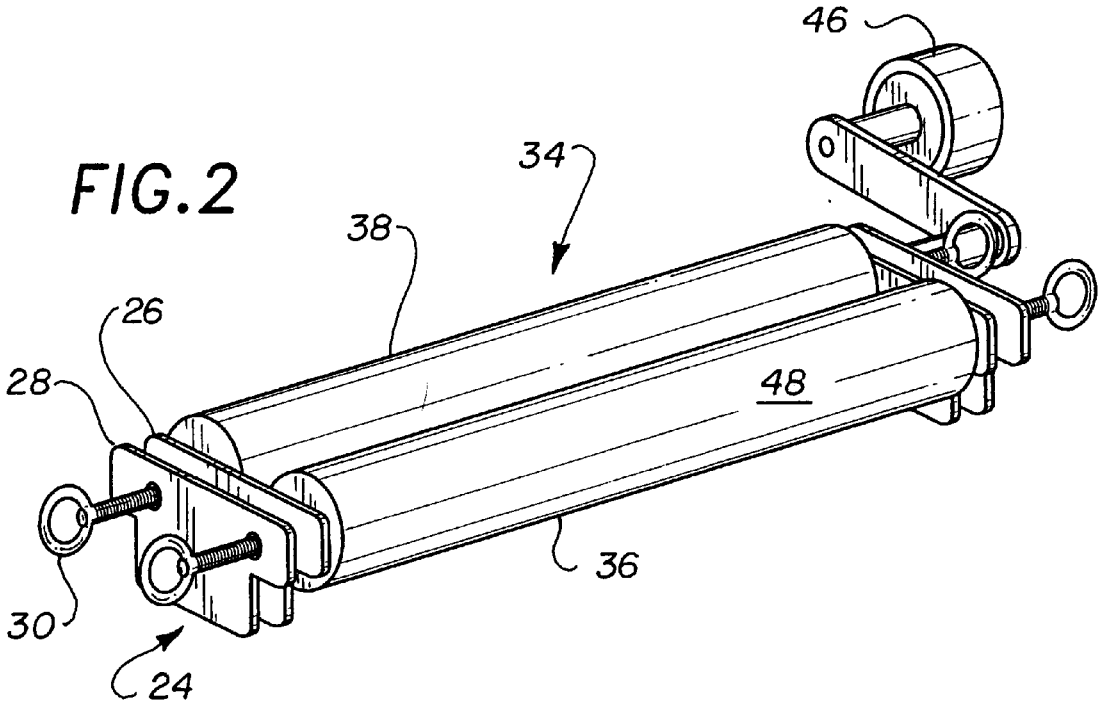
FIG. 2 is a perspective view of an alternate embodiment of the present invention.
Figure 3:
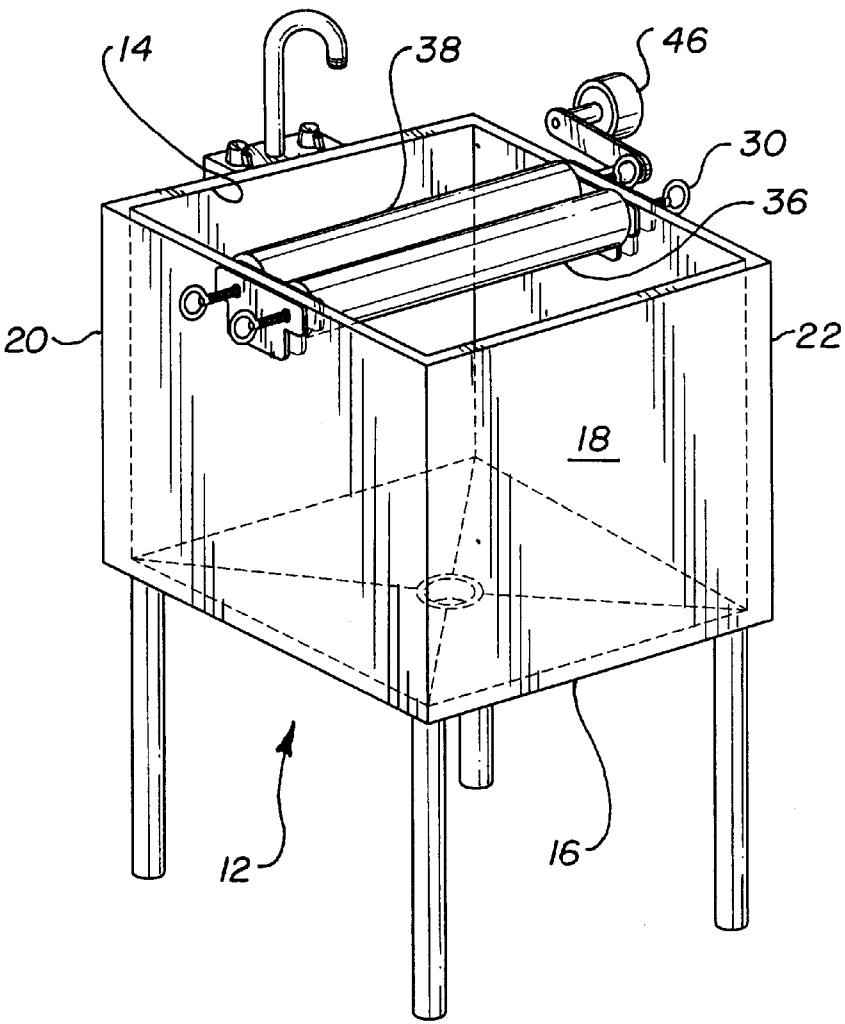
FIG. 3 is a perspective view of the preferred embodiment illustrated secured to a laundry sink.
Figure 4:
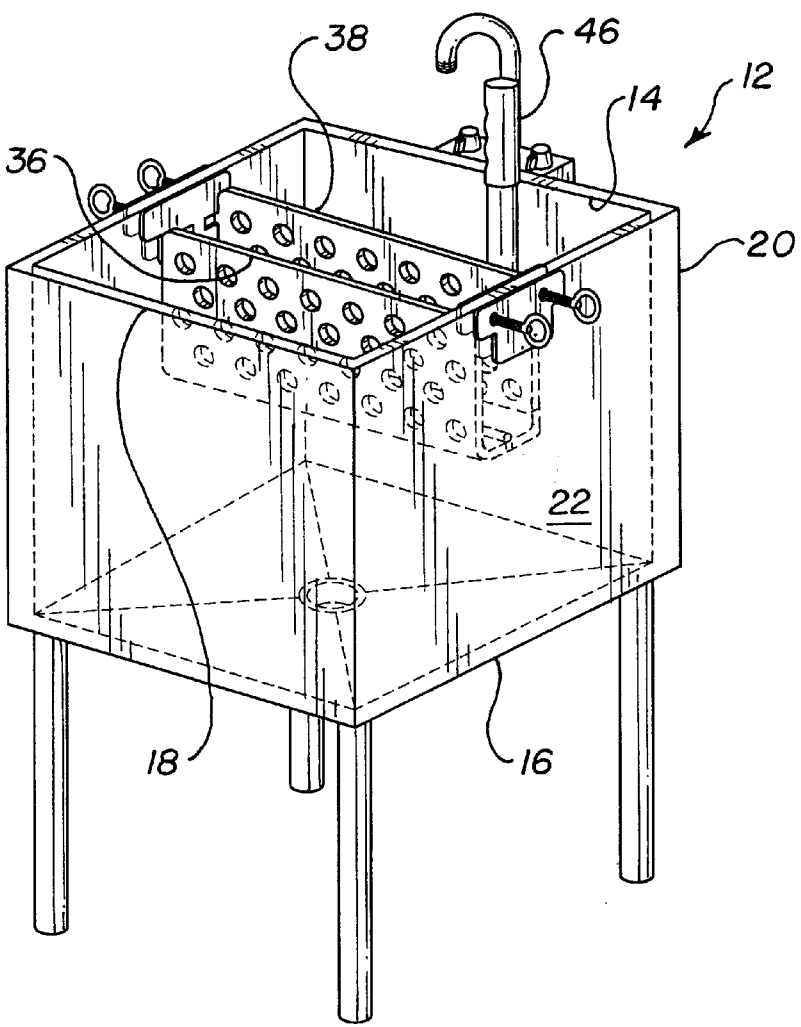
FIG. 4 is a perspective view of the alternate embodiment illustrated secured to a laundry sink.

A second embodiment of the present invention is shown in FIGS. 2 and 4 and includes substantially all of the components of the present invention wherein the rectangular plates 40 are replaced by cylindrical rollers 48.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A laundry sink attachment for wringing mops for allowing a wet mop to be easily wrung so as not to be required to lift a mop bucket to empty, whereby the laundry sink includes an open upper end, a closed lower end, a front wall, a back wall, and opposed side walls, the attachment comprising, in combination:

a pair of side brackets adapted for securement to the opposed side walls of the laundry sink, the pair of side brackets each including an interior and an exterior T-shaped plate, the interior plate being positionable on an inner surface of the side wall of the laundry sink, the exterior plate being positionable on an outer surface of the side wall of the laundry sink, the exterior plate having a pair of thumb screws extending inwardly thereof for engaging the opposed side wall in a secured orientation, the interior plates each having lateral channels formed therein; and a wringer portion secured between the pair of side brackets, the wringer portion including a fixed wringer and a slidable wringer, the fixed wringer and the slidable wringer each being comprised of a rectangular plate having a plurality of apertures therethrough, the rectangular plate having a pair of side tabs extending outwardly from side edges thereof for being received within the lateral channels of the interior plates of the side brackets, the slidable wringer including a handle member secured thereto to allow the slidable wringer to move inwardly against the fixed wringer.

2. A laundry sink attachment for wringing mops for allowing a wet mop to be easily wrung so as not to be required to lift a mop bucket to empty, whereby the laundry sink includes an open upper end, a closed lower end, a front wall, a back wall, and opposed side walls, the attachment comprising, in combination:

a pair of side brackets adapted for securement to the opposed side walls of the laundry sink, the pair of side brackets each including an interior and an exterior T-shaped plate, the interior plate being positionable on an inner surface of the side wall of the laundry sink, the exterior plate being positionable on an outer surface of the side wall of the laundry sink, the exterior plate having a pair of thumb screws extending inwardly thereof for engaging the opposed side wall in a secured orientation, the interior plates each having lateral channels formed therein; and a wringer portion secured between the pair of side brackets.

3. The laundry sink attachment for wringing mops as set forth in claim 2, wherein the wringer portion includes a fixed wringer and a slidable wringer.

4. The laundry sink attachment for wringing mops as set forth in claim 3, wherein the fixed wringer and the slidable wringer each is comprised of a rectangular plate having a plurality of apertures therethrough, the rectangular plate having a pair of side tabs extending outwardly from side edges thereof for being received within the lateral channels of the interior plates of the side brackets.

5. The laundry sink attachment for wringing mops as set forth in claim 4, wherein the slidable wringer includes a handle member secured thereto to allow the slidable wringer to move inwardly against the fixed wringer.

6. The laundry sink attachment for wringing mops as set forth in claim 3, wherein the fixed wringer and the slidable wringer each is comprised of a cylindrical roller, the cylindrical roller having a pair of side tabs extending outwardly from side edges thereof for being received within the lateral channels of the interior plates of the side brackets.

7. The laundry sink attachment for wringing mops as set forth in claim 3, wherein the slidable wringer includes a handle member secured thereto to allow the slidable wringer to move inwardly against the fixed wringer.

* * * * *